US006959698B2

(12) United States Patent
Ikuma et al.

(10) Patent No.: US 6,959,698 B2
(45) Date of Patent: Nov. 1, 2005

(54) FUEL TREATING CANISTER

(75) Inventors: Kouichi Ikuma, Hamakita (JP); Kazuhiro Yamaguchi, Hamakita (JP); Noritomo Endo, Hamakita (JP); Kazuya Matsuura, Hamakita (JP)

(73) Assignee: Toyo Roki Seizo Kabushiki Kaisha, Shizuoka (JP)

( * ) Notice: Subject to any disclaimer, the term of this patent is extended or adjusted under 35 U.S.C. 154(b) by 142 days.

(21) Appl. No.: 10/312,255

(22) PCT Filed: Jun. 24, 2002

(86) PCT No.: PCT/JP02/06296

§ 371 (c)(1),
(2), (4) Date: Dec. 24, 2002

(87) PCT Pub. No.: WO03/001047

PCT Pub. Date: Jan. 3, 2003

(65) Prior Publication Data

US 2004/0007135 A1 Jan. 15, 2004

(30) Foreign Application Priority Data

Jun. 26, 2001 (JP) ..... 2001-192935

(51) Int. Cl.[7] ..... F02M 33/02
(52) U.S. Cl. ..... 123/519; 55/444; 123/516
(58) Field of Search ..... 123/520, 519, 123/516, 518, 198 D; 55/442–446

(56) References Cited

U.S. PATENT DOCUMENTS 4,306,894 A 12/1981 Fukami et al.
4,693,393 A * 9/1987 DeMinco et al. ..... 220/374
5,024,687 A * 6/1991 Waller ..... 96/139
5,149,347 A * 9/1992 Turner et al. ..... 55/446
5,207,808 A 5/1993 Haruta et al.
5,398,660 A * 3/1995 Koyama et al. ..... 123/519
5,450,833 A 9/1995 Denz et al.
5,501,198 A 3/1996 Koyama
5,638,786 A * 6/1997 Gimby ..... 123/198 E
5,718,209 A * 2/1998 Scardino et al. ..... 123/519
5,776,227 A * 7/1998 Meiller et al. ..... 96/134
5,878,729 A * 3/1999 Covert et al. ..... 123/520
5,912,368 A 6/1999 Satarino et al.
6,279,548 B1 * 8/2001 Reddy ..... 123/520

FOREIGN PATENT DOCUMENTS

EP 0 955 459 11/1999
EP 1 154 145 11/2001

OTHER PUBLICATIONS

Patent Abstracts of Japan, JP 11 280569, Oct. 12, 1999 (Denso Corp.).
Patent Abstracts of Japan, JP 07 012017, Jan. 17, 1995 (Nippondenso Co. Ltd).
Patent Abstracts of Japan, JP 01 147154, Jun. 8, 1989 (Texas Instr. Japan Ltd.).

* cited by examiner

*Primary Examiner*—Carl S. Miller
(74) *Attorney, Agent, or Firm*—Young & Thompson

(57) ABSTRACT

A canister for treating evaporated fuel includes a casing which is provided with a fuel vapor inlet, a purge port and a port communicating with atmosphere and in which an adsorbent is accommodated, an air passage disposed inside the casing so as to communicate with the atmosphere communication port, the air passage having a shape for flowing the sucked air in a zigzag manner in the casing, and a filter element arranged between the air passage and the adsorbent disposed inside the casing.

13 Claims, 8 Drawing Sheets

FUEL TREATING CANISTER

TECHNICAL FIELD

The present invention relates to a fuel treating canister and, more particularly, to a canister for treating a fuel evaporated from a fuel supply source of a vehicle.

BACKGROUND ART

In general, a canister of the kind mentioned above has an adsorption chamber communicating with a passage communicating with atmosphere (hereinlater, called atmosphere communication passage) and a filter element in shape of sheet formed from felt or like is arranged at an end portion of this adsorption chamber. This filter element captures powdered coals generated, from activated carbons or charcoals filling in the adsorption chamber, through the mutual rubbing thereof caused by vibration or oscillation of a vehicle, and the filter element prevents the captured powdered coals from being discharged outside a canister case through the atmosphere communication passage.

Furthermore, prior art also provides a canister which is provided with a dust removing filter element of a type different from that of the canister mentioned above for the purpose of removing dust or like in the atmosphere taken into the canister through an atmosphere communication passage at a time of purge.

For example, Japanese Patent Laid-open (KOKAI) Publication No. HEI 11-280569 discloses a canister including an adsorbent case in which a filter chamber is formed independent from an adsorption chamber, and in the filter chamber, a filter element for filtering air taken into the filter chamber through an atmosphere communication passage is disposed. This filter chamber is arranged by being fused to one surface of the canister or being connected independently from the canister.

In the canister disclosed in the publication mentioned above, however, a canister body has an increased lateral width, making large an entire structure or shape thereof, which influences canister location space in a vehicle, thus providing an inconvenience. Furthermore, in the arrangement in which the filter chamber is independently disposed, the number of parts or members increases, and a manufacturing cost is also increased because of the fusing process or like, also providing a disadvantage. Still furthermore, there may provide a problem such that the filter element is clogged by dust or like absorbed through the atmosphere communication passage, which may result in shortage of lifecycle of the canister.

In view of the defects or drawbacks encountered in the prior art mentioned above, the present invention aims to provide a canister having a structure capable of removing dust or like and preventing clogging of a filter element without changing basic design or shape of the canister.

DISCLOSURE OF THE INVENTION

In order to achieve the above and other objects, according to the present invention, there is provided, in one aspect, a canister for treating evaporated fuel comprising:

a casing which is provided with a fuel vapor inlet, a purge port and a port communicating with atmosphere and in which an adsorbent is accommodated;

an air passage disposed inside the casing so as to communicate with the atmosphere communication port, the air passage having a shape so as to create a meandering flow of the sucked air in a horizontal direction of the casing; and a filter element arranged between the air passage and the adsorbent disposed inside the casing.

In a preferred embodiment of this aspect, the air passage is composed of a bottom plate having an opening and a sectioning wall disposed on the bottom plate and having a shape preventing the air introduced through the atmosphere communication port from advancing straight towards the opening formed to the bottom plate. The bottom plate and the sectioning wall is formed into a unit to be inserted into the casing so as to form the air passage. The air passage may be formed integrally with the casing.

According to this aspect, the air passage is formed so that the introduced air flows in the meandering manner in the horizontal direction in the casing along the bottom plate constituting the air passage. The dust contained in the air introduced through the atmosphere communication port collides with the air passage wall during the passing through the air passage and, at this collision, the dust is separated from the air and piled on the bottom plate of the air passage, thus removing the dust. Therefore, the air reaching the air filter includes substantially no dust, so that the filter element can be prevented from being clogged, and hence, the filter element can be used for a long time without being changed. Moreover, since the air passage and the filter element can be disposed inside the casing, it is not necessary to change the basic structure or configuration of the canister at the formation of the air passage. Furthermore, by constituting the air passage so as to provide a unit structure, the air passage unit can be inserted into the casing. Thus, the air passage can be easily formed inside the casing of the canister without changing the configuration or arrangement of the canister.

On the other hand, by forming the air passage integrally with the casing, the number of constitutional parts or elements can be reduced.

In order to achieve the above and other objects, according to another aspect of the present invention, there is further provided a canister for treating evaporated fuel comprising:

a casing which is provided with a fuel vapor inlet, a purge port and a port communicating with atmosphere and in which an adsorbent is accommodated;

an air passage disposed inside the casing so as to communicate with the atmosphere communication port, the air passage having a shape so as to create a meandering flow of the sucked air in a vertical direction of the casing; and a filter element arranged between said air passage and said adsorbent disposed inside the casing.

In a preferred embodiment of this aspect, the air passage is composed of a bottom plate having an opening and a sectioning wall including a first wall section extending from a side wall of the casing and a second wall section extending from the bottom plate, the first and second wall sections being arranged in a zigzag shape so as to prevent the air introduced through the atmosphere communication port from advancing straight towards the opening formed to the bottom plate. The bottom plate and the sectioning wall is formed into a unit to be inserted into the casing so as to form the air passage. The air passage may be formed integrally with the casing.

According to this aspect, the air passage is formed so that the introduced air flows in the meandering manner in the vertical direction in the casing by the sectioning walls arranged in zigzag form at upper and lower portions in the air passage. The dust contained in the air introduced through the atmosphere communication port collides with the sectioning wall during the passing of the air passage and, at this collision, the dust is separated from the air and piled on the bottom plate of the air passage, thus removing the dust. Therefore, the air reaching the air filter includes substantially no dust, so that the filter element can be prevented from being clogged, and hence, the filter element can be used for a long time without being changed. Moreover, since the air passage and the filter element can be disposed inside the casing, it is not necessary to change the basic structure or configuration of the canister at the formation of the air passage. Furthermore, in this aspect, also by constituting the air passage to provide a unit structure, the air passage unit can be inserted into the casing. Thus, the air passage can be easily formed inside the casing of the canister without changing the configuration or arrangement of the canister.

On the other hand, by forming the air passage integrally with the casing, the number of parts or elements can be reduced.

In order to achieve the above and other objects, according to a further modified aspect of the present invention, there is provided a canister for treating evaporated fuel comprising:

a casing including a case body into which an adsorbent is accommodated, a cover member covering a top opening of the case body and a bottom member closing a bottom opening of the casing, the cover member being provided with a fuel vapor inlet through which a fuel vapor is introduced into the casing and a purge port, the case body being provided with a port communicating with atmosphere;

an air passage disposed inside the case body so as to communicate with the atmosphere communication port, the air passage being composed of a base plate having an opening and a sectioning wall disposed on the base plate and having a shape preventing the air introduced through the atmosphere communication port from advancing straight towards the opening formed to the base plate; and a filter element arranged between the air passage and the adsorbent disposed inside the case body.

In this aspect, the air passage is formed into a unit to be inserted into the case body, or the air passage may be formed integrally with the case body.

The case body and the cover member is sectioned by a section member, the case body has an inner space which is divided into first and second spaces by the section member and a partition wall extending downward from the section member, the air passage is disposed in the second space so as to be communicated with the atmosphere communication port, and the filter element is disposed below the air passage. The sectioning wall includes wall sections arranged in a zigzag shape to prevent the air introduced through the atmosphere communication port from advancing straight towards the opening formed to the base plate.

According to this modified aspect, substantially the same functions and advantageous effects as those mentioned above may be achieved.

The nature and further characteristic features of the present invention will be made more clear from the following descriptions with reference to the accompanying drawings.

BRIEF DESCRIPTION OF THE DRAWINGS

FIG. 6 shows a unit for forming an air passage, in which

FIG. 7 shows a unit for forming another air passage, in which

BEST MODE FOR EMBODYING THE INVENTION

A first embodiment of a canister according to the present invention will be first described hereunder with reference to FIGS. 1 to 4.

Figure 1:
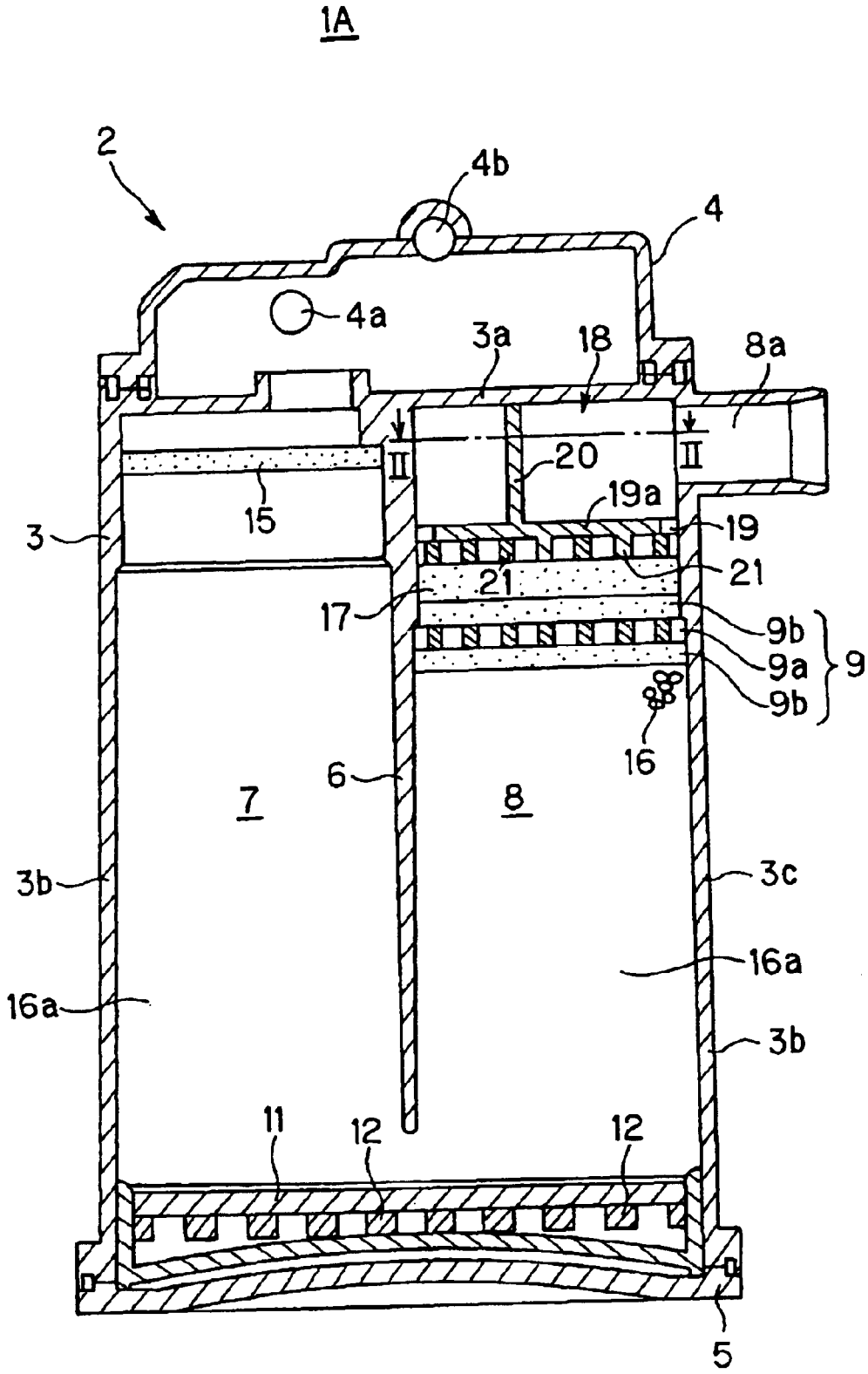
FIG. 1 is an elevational section showing an entire structure of a canister according to a first embodiment of the present invention.

With reference to FIG. 1, a reference numeral 1A denotes a canister mounted to a vehicle such as automobile equipped with an internal combustion engine as a driving mechanism and adapted to treat a fuel vapor generated (evaporated) in a fuel supply source such as fuel tank.

Further, it is to be noted that, in the following description, terms "upper", "lower", "right", "left" and the like are used in conformity with the illustrated state of the canister, but such terms do not define the direction of the canister in an actual use.

The canister 1A has an outer casing 2 made of resin, and the casing 2 is composed of an adsorbent case 3 and an upper cover 4 fused to the adsorbent case 3. The adsorbent case 3 comprises a rectangular cylindrical case body 3*c* and a bottom cover 5 closing a lower end opening of the case body 3*c*. The case body 3*c* comprises an upper wall section 3*a* having an approximately rectangular shape as viewed from the upper side thereof and four side wall sections 3*b*, 3*b*, 3*b*, 3*b* (only left and right side wall sections are shown) perpendicularly extending from outer peripheral side end portions of the upper wall section 3*a*.

The inner space of the adsorbent case 3 is sectioned into a first space area 7 and a second space area 8 by a partition wall 6 extending from substantially the central portion of the upper wall section 3*a* downward substantially in parallel to the side wall section 3*b*. The second space area 8 is further sectioned by an intermediate wall 9 transversely arranged to an upper portion in the second space area 8. The intermediate wall 9 is provided with a grid 9*a* formed with a number of vertical through holes and filter elements 9*b*, 9*b*, each in shape of sheet, closely adhering to upper and lower surfaces of the grid 9*a*.

A filter element 17 is further disposed above the intermediate wall 9. The second space area 8 includes, at its upper end side, an air passage 18 communicating with a port 8*a* communicating with atmosphere (hereunder, called atmosphere communication port 8*a*), integrally with the inside of the adsorbent case 3.

Next, with reference to FIGS. 2 and 3, the structure of the air passage 18 will be explained.

The air passage 18 is defined by a bottom plate 19 disposed to an upper portion of the second space area 8 and a partition wall 20 including wall sections 20*a* to 20*c*. The bottom plate 19 is formed with an opening 19*a*, in a rectangular shape, so as to communicate with the filter element 17 disposed below the bottom plate 19. A plurality of projections 21, 21, - - - , 21 are formed to the lower surface of the bottom plate 19 with a constant interval arrangement, and extending end portions of these projections 21 contact the upper surface of the filter element 17 to thereby define a space between the bottom plate 19 and the filter element 17. According to the provision of such space, air introduced through the opening 19*a* formed to the bottom plate 19 can be sucked over the entire surface of the filter element 17.

The partition wall 20 comprises a first partition wall section 20*a*, a second partition wall section 20*b* and a third partition wall section 20*c*, which are arranged in zigzag form. The first partition wall section 20*a* extends from the side wall 3*b*, to which the atmosphere communication port 8*a* is formed, and then bent in substantially L-shape so as to prevent the air introduced through the atmosphere communication port 8*a* from advancing straight. The first partition wall section 20*a* contacts the upper wall section 3*a* and the bottom plate 19. The second partition wall section 20*b* extends from the side wall 3*b*, to which the atmosphere communication port 8*a* is formed, towards the opposing partition wall 6, and the second partition wall section 20*b* also contacts the upper wall section 3*a* and the bottom plate 19. The third partition wall section 20*c* extends from the partition wall 6 towards the side wall 3*b* to which the atmosphere communication port 8*a* is formed, and the third partition wall section 20*c* also contacts the upper wall section 3*a* and the bottom plate 19.

As shown in FIG. 1, for example, a pad 11 having an elasticity and ventilative structure is disposed to the lower end portion of the adsorbent case 3, and a grid 12 having a number of vertical through holes is further disposed below the pad 11. A bottom cover 5 is applied from the further lower side of the grid 12 to close the bottom opening of the adsorbent case 3. The bottom cover 5 has an outer periphery which is air-tightly joined to the entire lower end periphery of the case body 3*c* by means of fusing, for example, thus completing the air-tight closing of the lower end portion of the adsorbent case 3. The grid 12 is pressed upward by the tightly joined bottom cover 5 and then the pad 11 is pushed upward. Accordingly, the activated carbon in the adsorbent layer in the inner space of the adsorbent case 3 is properly packed.

The filter element 15 in shape of sheet is disposed at the upper end portion of the first space area 7, and below this filter element, there is formed an adsorbent layer 16*a* filling with the activated carbon as adsorbent 16. Further, an activated carbon as the adsorbent fills the space below the intermediate wall 9 to form an adsorbent layer 16*a*.

The upper cover 4 is formed with a fuel vapor inlet 4*a* communicating with a fuel tank and a purge port 4*b* communicating with a suction unit of an internal combustion engine. The fuel vapor inlet 4*a* and the purge port 4*b* are both communicating with the first space area 7 in the adsorbent case 3. Further, an atmosphere communication port 8*a* communicating with the second space area 8 in the adsorbent case 3 is formed to an upper portion of the side wall section 1*b* contacting the second space area 8.

The fuel vapor generated at the engine operation stop time is introduced into the adsorbent case 3 through the fuel vapor inlet 4*a*, and fuel component contained in the vapor is adsorbed or absorbed by the adsorbent layer 16*a*. In the meantime, when the engine is operated, the air is sucked and introduced, through the purge port 4*b*, by a negative pressure caused in the suction system of the internal combustion engine, and accordingly, the atmosphere is sucked through the atmosphere communication port 8*a*. Thus, the fuel component adsorbed by the adsorbent layer 16*a* is taken together with the atmosphere into the suction system of the internal combustion engine.

Figure 4:
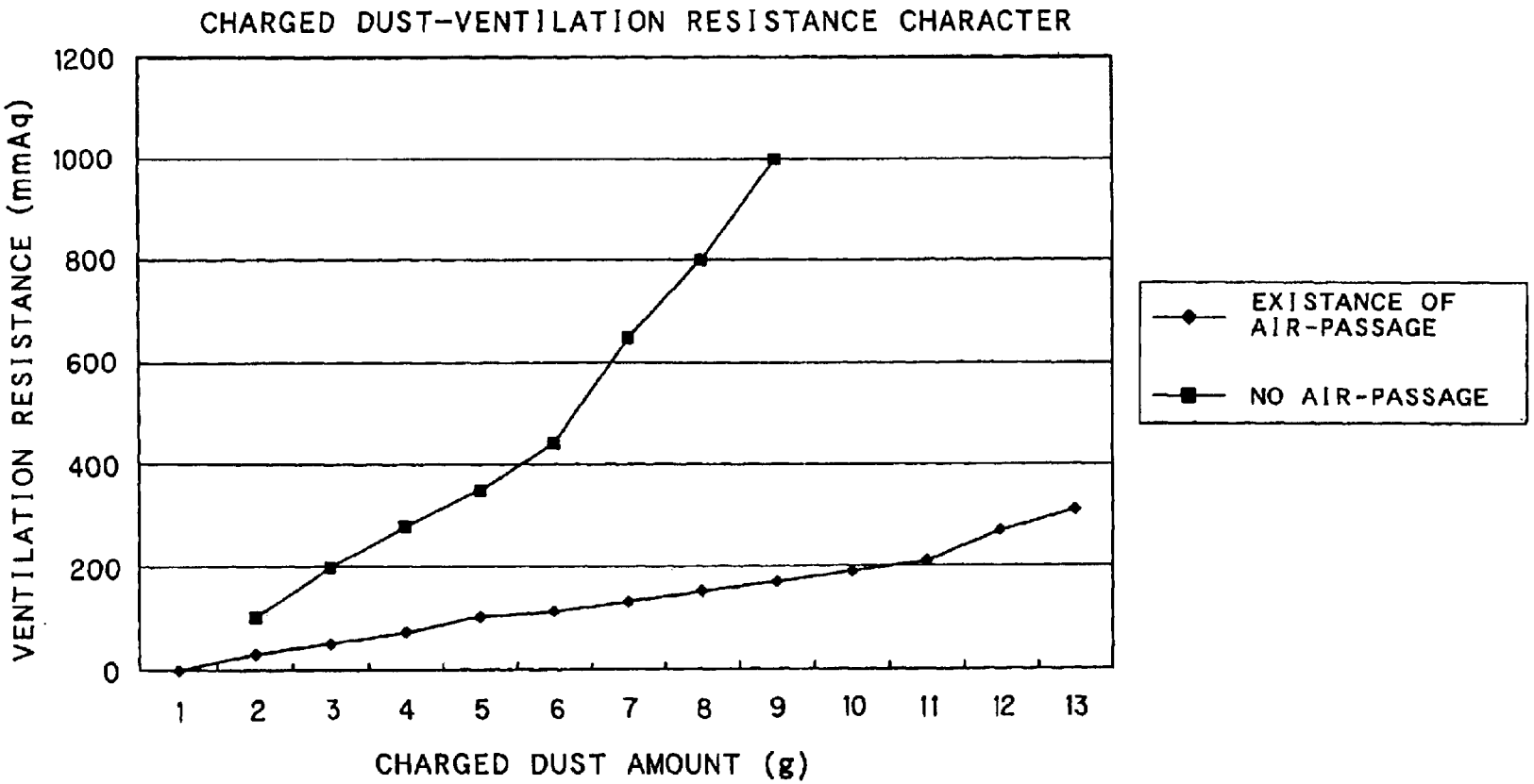
FIG. 4 is a graph representing a ventilation resistance characteristic at a time when air including dust is taken in an air passage.

FIG. 4 is a graph representing a result of measurement of ventilation resistance with respect to charged dust amount at a time of provision of air passage to the canister or no provision thereof. The difference in the provision or non-provision of the air passage resides in that, in the non-provision of the air passage to the canister, air containing dust is sucked by the adsorbent layer only through the filter element, and on the contrary, in the provision of the air passage to the canister, dust is once removed by the air passage and, thereafter, is sucked by the adsorbent layer through the filter element.

The measurement shown in FIG. 4 was carried out by sucking the air contained with dust through the atmosphere communication port with aimed value 12(g) of charged dust. That is, the dust was gradually increased in the range of dust amount of 0 to 12(g). As a result, as can be seen from the graph of FIG. 4, in the canister provided with no air passage, as the charged dust amount increases, the air resistance extremely increases and it was impossible to suck the air to the aimed value. On the other hand, in the canister provided with the air passage, even if the charged dust amount increased, the air resistance was not changed so significantly and it was possible to suck the air over the aimed value.

Accordingly, from the above result, it has been considered that, in the structure of the canister provided with no air passage, since the dust contained in the air was removed as it is by the filter element, according to the increasing of the charged dust, the filter element was clogged and the air resistance was hence extremely increased. On the other hand, it has been also considered that, in the structure of the canister provided with the air passage, the dust contained in the air collided with the passage wall or partition wall and separated at the time passing through the air passage, and thereafter, the dust was sucked by the filter element, so that the filter element wan not clogged and the air resistance did not substantially changed even if the charged dust amount increased.

As mentioned above, when the air is taken through the atmosphere communication port 8*a*, the air passes the air passage 18, and thereafter, is sucked to the suction system of the internal combustion engine through the filter element 17 and the adsorbent layer 16*a*, and then, through the purge port 4*b*.

The air sucked through the atmosphere communication port 8*a* contains the dust, such dust collides, during the passing through the air passage 18, with the passage wall (including partition wall 6 and side wall sections 3*b*, 3*b*) or partition wall 20 (wall sections 20*a* to 20*c*), and at the time of such colliding, the dust is separated and piled entirely on the bottom plate 19 of the air passage 18. For this reason, when the air passes through the filter element 17, since the dust has already been removed in the air passage 18, the filter element is not clogged, and hence, the filter element 18 can be used for a long time without being clogged.

Furthermore, since the air passage 18 and the filter element 17 are integrally arranged in the adsorbent case 3 as dust removing means, the canister can provide a compact structure without changing the substantial shape of the canister body with reduced number of parts or components.

Figure 2:
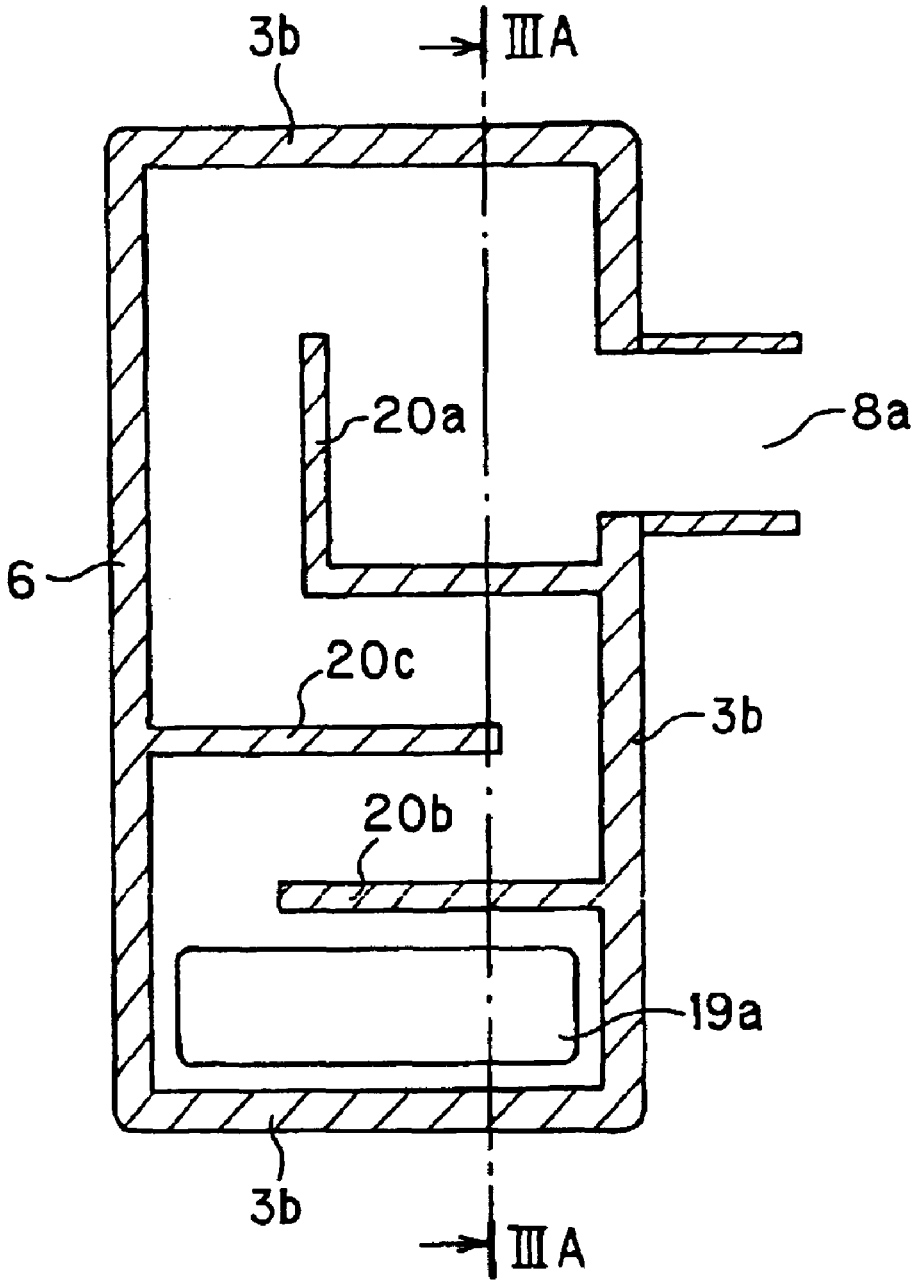
FIG. 2 is a sectional view taken along the line II—II in FIG. 1.
Figure 3A:
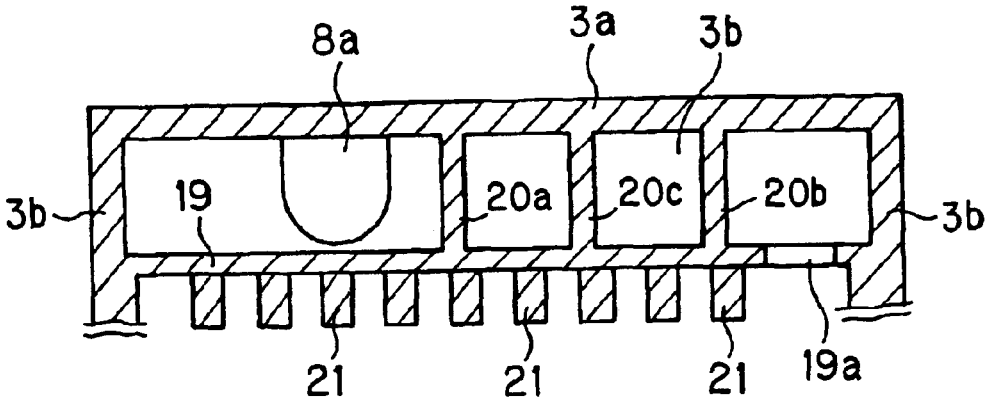
FIG. 3 shows a structure of an air passage and includes FIG. 3A being a sectional view taken along the line IIIA—IIIA in FIG. 2 and FIG. 3B being a bottom view thereof.
Figure 3B:
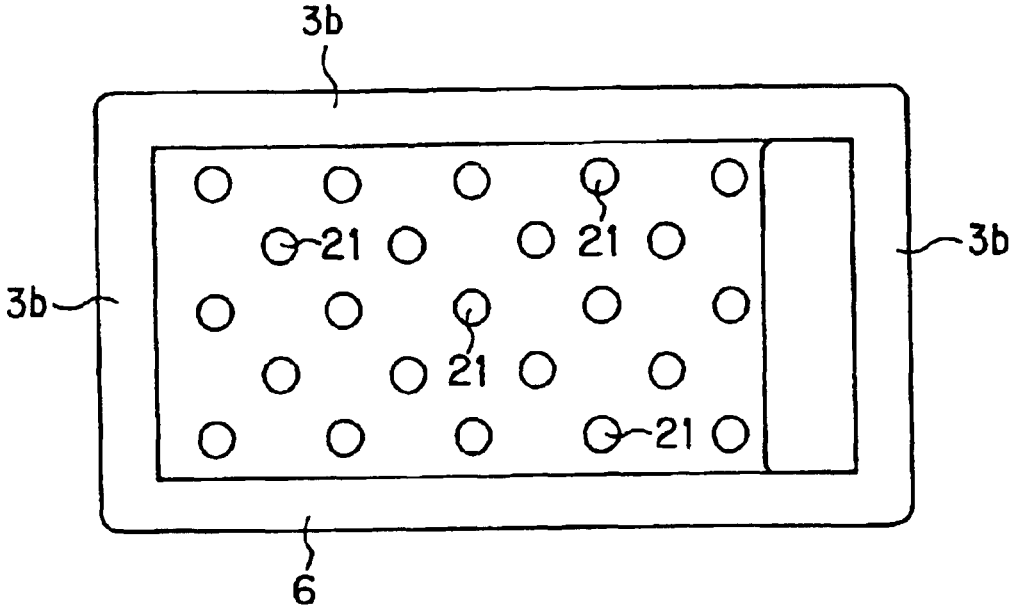
Figure 5:
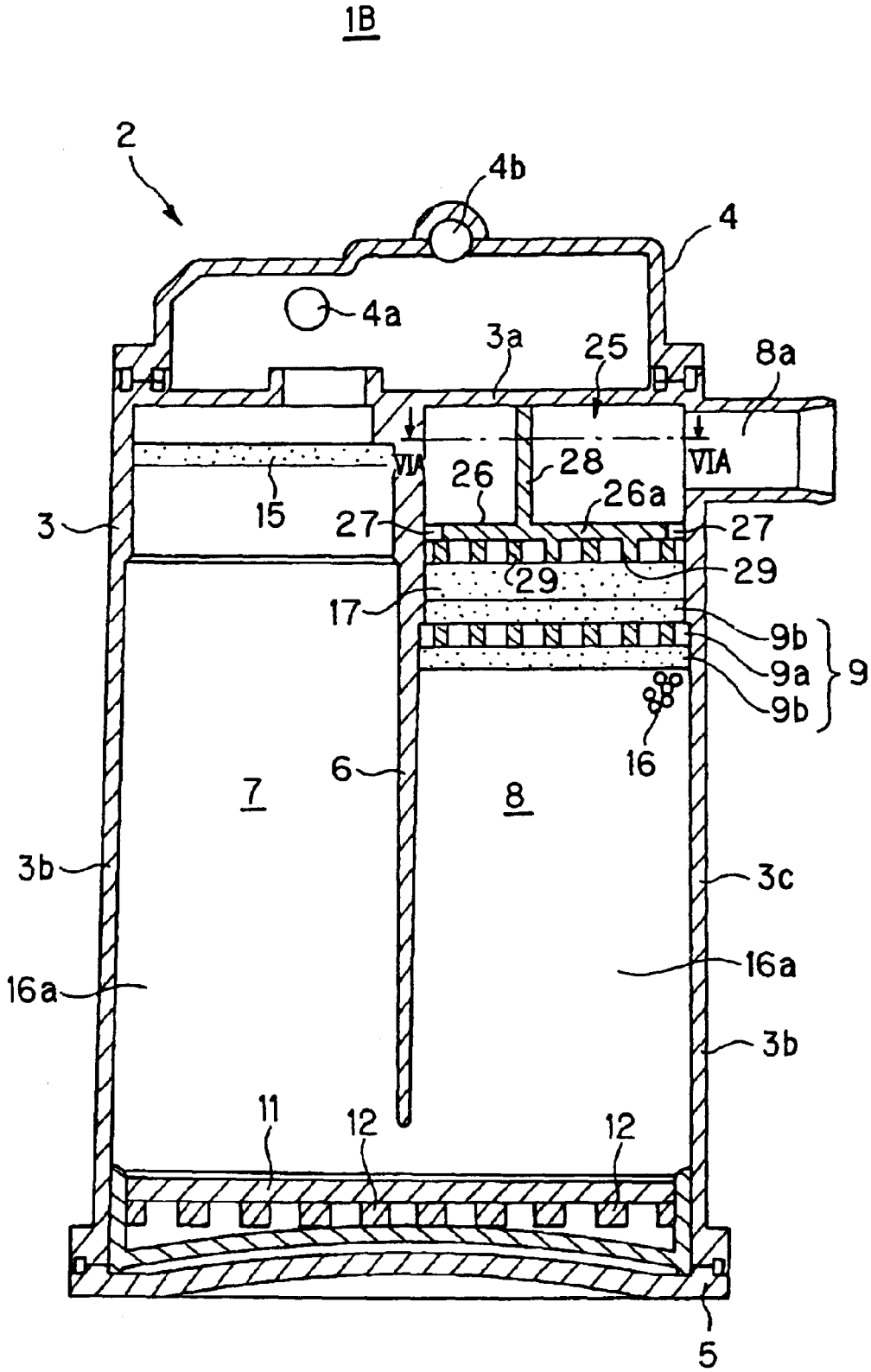
FIG. 5 is an elevational section showing an entire structure of a canister according to a second embodiment of the present invention.
Figure 6A:
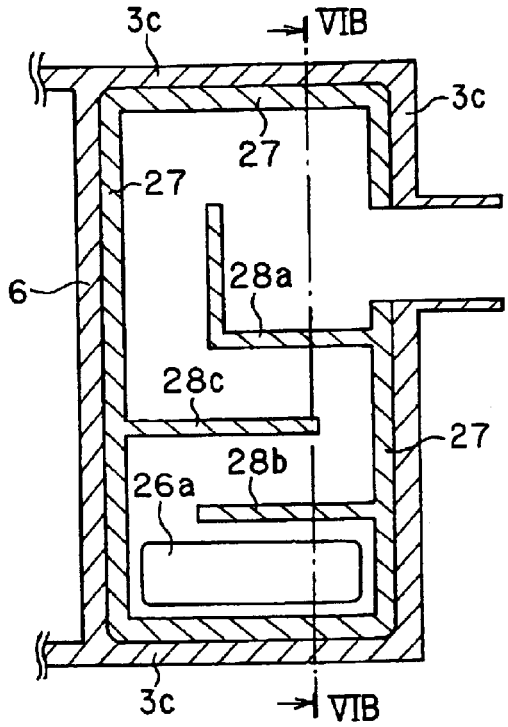
FIG. 6A is a sectional view taken along the line VIA—VIA in FIG. 5.
Figure 6B:
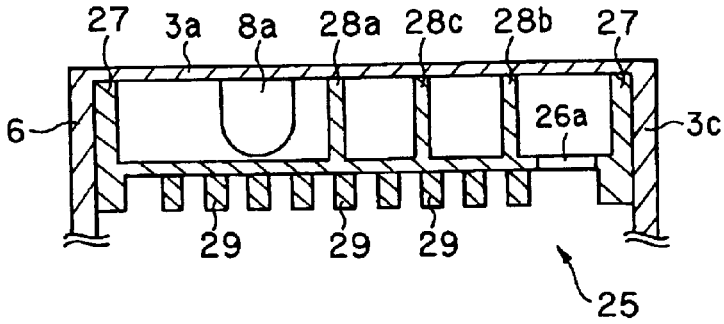
FIG. 6B is a sectional view taken along the line VIB—VIB in FIG. 6A
Figure 6C:
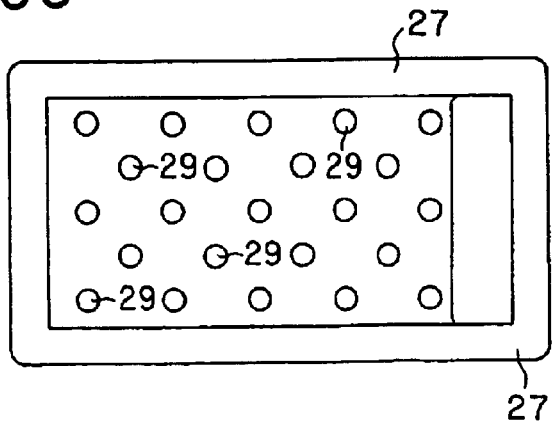
FIG. 6C is a bottom view thereof.

FIGS. 5 and 6 represent a canister according to a second embodiment of the present invention, in which like reference numerals are added to portions or elements corresponding to those of the first embodiment shown in FIGS. 1 to 3 and detailed explanation thereof are omitted hereunder.

With reference to FIGS. 5 and 6, a canister 1B of this second embodiment is provided with air passage by inserting a unit 25 into an upper end portion of the second space area 8 in the adsorbent case 3.

This unit 25 is composed of a base plate 26 sectioning a space surrounded by the side wall sections 3*c*, 3*c*, 3*c* and the partition wall 6, a supporting plate member 27 standing around the outer periphery of the base plate 26, and a sectioning wall 28. The base plate 26 is formed with an opening 26*a* having a rectangular shape. A plurality of projections 29, 29, - - - , 29 are provided to the lower surface of the base plate 26 so as to extend downward at constant interval arrangement. The supporting plate member 27 has an upper end edge contacting the upper wall section 3*a* and a lower end edge contacting the filter element 17.

The sectioning wall 28 is disposed so as to extend towards the partition wall side opposing to the side wall to which the atmosphere communication port is formed. That is, this sectioning wall 28 includes a wall section 28*a* having an L-shape so as to prevent the atmosphere sucked through the atmosphere communication port 8*a* from advancing straightly, a wall section 28*b* extending from the side wall section 3*c*, to which the atmosphere communication port 8*a* is formed, towards the opposing partition wall side, and a wall section 28*c* extending from the partition wall towards the opposing side wall section, these wall sections being formed in a zigzag arrangement on the surface of the base plate 26.

Figure 7A:
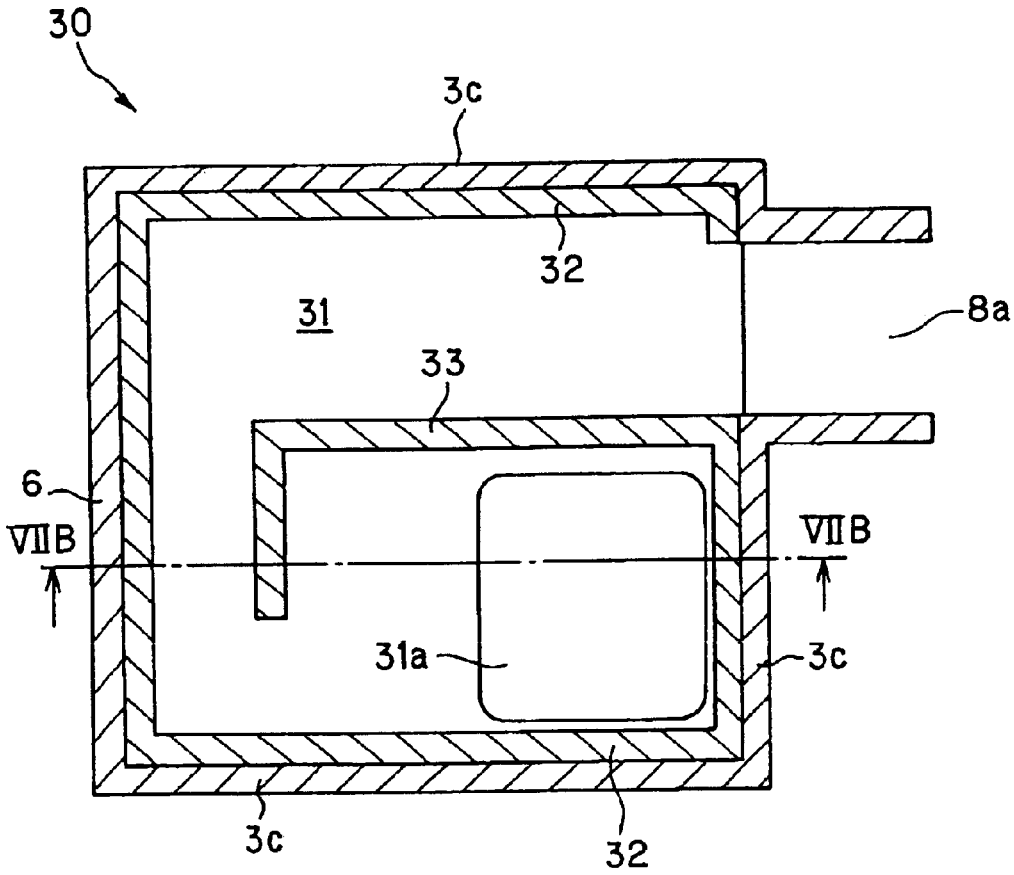
FIG. 7A is a plan view thereof and FIG. 7B is a sectional view taken along the line VIIB—VIIB in FIG. 7A.
Figure 7B:
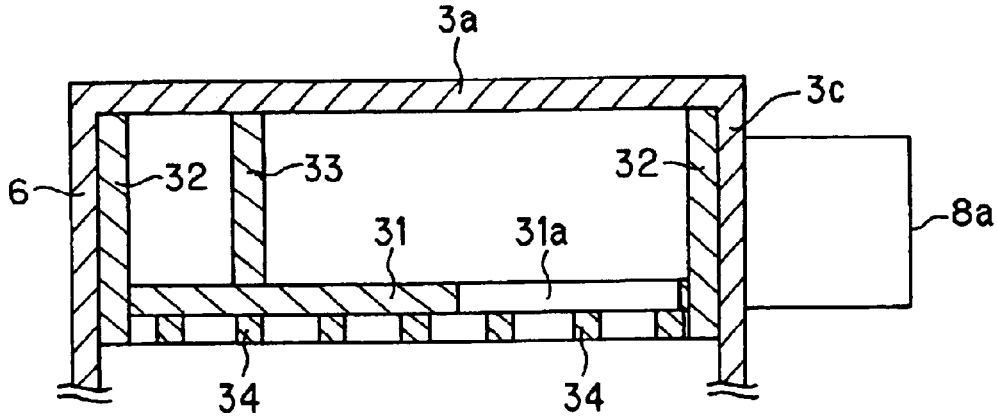

With further reference to FIG. 7, another example of the unit for forming the air passage will be explained hereunder, in which like reference numerals are added to those corresponding to portions or elements described with reference to the example shown in FIG. 6.

A unit 30 of this example is inserted to the upper end portion of the second space area 8 as in the second embodiment mentioned above to thereby define an air passage. This unit 30 is provided with a base plate 31 sectioning a space surrounded by the side wall sections 3*c*, 3*c*, 3*c* and the partition wall 6, a supporting plate member 32 standing around the outer periphery of the base plate 31 and a sectioning plate 33 mentioned in detail hereinlater.

The base plate 31 is formed with an opening 31*a* having a rectangular shape. A plurality of projections 34, 34, - - - , 34 are provided to the lower surface of the base plate 31 so as to extend downward at constant interval arrangement. The supporting plate member 32 has an upper end edge contacting the upper wall section 3*a* and a lower end edge contacting the filter element 17.

The sectioning wall 33 is formed so as to stand on the surface of the base plate 31 and extend from the side wall section 3*c*, to which the atmosphere communication port 8*a* is formed, towards the opposing partition wall 6, the sectioning wall 33 having substantially an L-shape so as to prevent the atmosphere sucked through the atmosphere communication port 8*a* from advancing straight towards the partition wall 6.

According to the canisters of the embodiments mentioned above, the air passage can be formed only by inserting the unit 25 or 30 to the upper end portion of the second space area 8 inside the adsorbent case 3. Furthermore, one side of the air passage communicates with the atmosphere communication port 8*a* and the other one side communicates with the filter element 17 and the adsorbent layer 16*a*. Still furthermore, since the air passage is formed as a unit, the respective parts or elements can be easily manufactured, and moreover, since the air passage for removing the dust or like can be provided inside the casing 2, it is not necessary to change the outer configuration of the canister.

Figure 8:
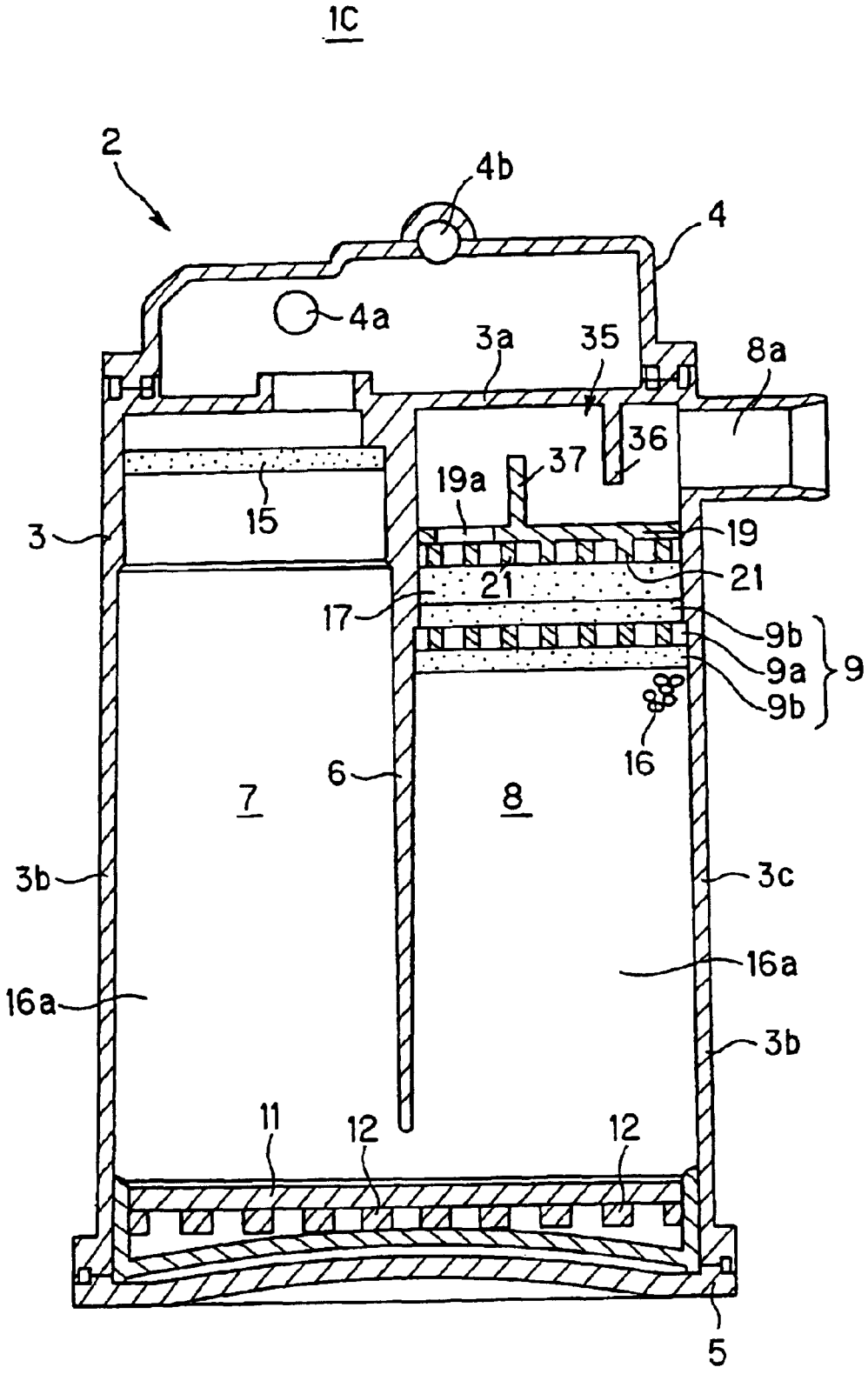
FIG. 8 is an elevational section showing an entire structure of a canister according to a third embodiment of the present invention.

With further reference to FIG. 8, being an elevational section, a canister according to the third embodiment of the present invention will be explained hereunder, in which like reference numerals are added to those corresponding to portions or elements described with reference to the example shown in FIG. 1.

The canister 1*c* of this embodiment is provided with a dust removing structure including an air passage 18 and a filter element 17, and the air passage 18 in the former embodiment has a structure so that the introduced air flows in a meandering manner in a perpendicular direction as viewed.

The air passage 35 of this embodiment is defined by the bottom plate 19 disposed to an upper portion of the second space area 8, a first sectioning wall 36 and a second sectioning wall 37. The bottom plate 19 is provided with an opening 19*a* having a rectangular shape so as to be communicated with the filter element 17 disposed below the bottom plate 19. Furthermore, a plurality of projections 21, 21, - - - , 21 are provided to the lower surface of this bottom plate 19 at constant interval arrangement so as to extend downward to contact the filter element 17.

The first sectioning wall 36 forming the air passage extends from the upper wall section 3*a* of the adsorbent case 3 towards the opposing bottom plate 19, and both end portions, in the width direction of the adsorbent case 3 (perpendicular direction to the drawing surface) of the first sectioning wall 36 contact the side wall sections 3*b*, 3*b*, respectively.

On the other hand, the second sectioning wall 37 extends towards the upper wall section side opposing to the bottom plate 19 so that both end portions thereof in the width direction of the adsorbent case 3 contact the side wall sections 3*b*, 3*b*, respectively.

The first and second sectioning walls 36 and 37 are arranged in zigzag form so that the air flows substantially in the meandering manner in the perpendicular (vertical) direction.

As mentioned above, the air passage 35 is formed so that the air taken into this air passage flow in the meandering manner in the perpendicular direction, so that the dust contained in the sucked air collides with the sectioning walls 36 and 37 and is then separated from the air and piled on the upper surface of the bottom plate 19 to thereby remove the dust. Further, the dust piled on the bottom plate 19 is not moved towards the filter element 17 from the separated and piled portion because of the location of the sectioning wall 37 vertically standing from the bottom plate 19.

It is to be noted that the present invention is not limited to the described embodiment and many other changes and modifications may be made without departing from the scopes of the appended claims.

For example, in the described embodiments, the number of the sectioning wall or wall sections is not limited, and a plurality of sectioning walls may be utilized or the air passage of the third embodiment may be formed as a unit to be inserted.

INDUSTRIAL APPLICABILITY

According to the present invention, as mentioned above, the air passage for removing dust or like is formed in the vicinity of a port communicating with atmosphere. Therefore, the dust can be removed at the inside of the air passage, and, hence, the filter element can be prevented from being clogged. Moreover, since the air passage for removing the dust is disposed inside the canister, it is possible to change the shape or configuration of the canister. Parts or elements constituting the canister can be reduced, contributing manufacturing cost reduction, thus being industrially applicable.

What is claimed is:

1. A canister for treating evaporated fuel comprising:

a casing provided with a fuel vapor inlet, a purge port and an atmosphere communication port, said casing having a space area, one side of which space area communicates with said fuel vapor inlet and said purge port and another side of which space area communicates with said atmosphere communication port; and an adsorbent accommodated in the space area of said casing;

an air meandering passage disposed between said atmosphere communication port and said another side of the space area, said air meandering passage causing air sucked from the atmosphere communication port to zigzag to reach said another side of the space area; and a filter element disposed between said air meandering passage and said another side of the space area, said filter element filtering the air and introducing filtered air into said space area, wherein said air meandering passage meanders on a plane, which is perpendicular to a longitudinal direction of the casing.

2. The canister according to claim 1, wherein said air passage comprises an end plate having an opening and a baffle member disposed on the end plate and having a shape preventing the air introduced through said atmosphere communication port from advancing straight toward the opening of the end plate.

3. A canister for treating evaporated fuel comprising:

a casing provided with a fuel vapor inlet, a purge port and an atmosphere communication port, said casing having a space area, one side of which space area communicates with said fuel vapor inlet and said purge port and another side of which space area communicates with said atmosphere communication port; and an adsorbent accommodated in the space area of said casing;

an air meandering passage disposed between said atmosphere communication port and said another side of the space area, said air meandering passage causing air sucked from the atmosphere communication port to zigzag to reach said another side of the space area; and a filter element disposed between said air meandering passage and said another side of the space area, said filter element filtering the air and introducing filtered air into said space area, wherein said air meandering passage meanders on a plane, which includes a longitudinal direction of the casing, and wherein said air passage comprises an end plate having an opening and a baffle member including a first wall section and a second wall section, said first and second wall sections extending from different positions in opposite directions to each other so as to prevent the air introduced through said atmosphere communication port from advancing straight toward the opening of the end plate.

4. The canister according to claim 2, wherein said end plate and said sectioning wall are formed into a unit to be inserted into the casing so as to form the air meandering passage.

5. The canister according to claim 3, wherein said end plate and said first and second wall sections are formed into a unit to be inserted into the casing so as to form the air meandering passage.

6. The canister according to claim 2, wherein said air passage is formed integrally with the casing.

7. The canister according to claim 3, wherein said air passage is formed integrally with the casing.

8. A canister for treating evaporated fuel comprising:

a casing provided with a fuel vapor inlet, a purge port and an atmosphere communication port, said casing having a space area, one side of which space area communicates with said fuel vapor inlet and said purge port and another side of which space area communicates with said atmosphere communication port; and an adsorbent accommodated in the space area of said casing;

an air meandering passage disposed between said atmosphere communication port and said another side of the space area, said air meandering passage causing air sucked from the atmosphere communication port to zigzag to reach said another side of the space area; and a filter element disposed between said air meandering passage and said another side of the space area, said filter element filtering the air and introducing filtered air into said space area, wherein said casing comprises a case body having a first opening at one end thereof and a second opening at another end thereof, a first cover member for closing said first opening and a second cover member for closing said second opening, said first cover member having said fuel vapor inlet and said purge port and said case body having said atmosphere communication port.

9. The canister according to claim 8, wherein said air passage is formed into a unit to be inserted into the case body.

10. The canister according to claim 8, wherein said air passage is formed integrally with the case body.

11. The canister according to claim 8, wherein said case body comprises a section member provided at said one end of said case body and a partition wall extending from said section member by which said space area is divided into first and second space area sections;

said air meandering passage is disposed in said second space area section; and said filter element is disposed below the air meandering passage.

12. A canister for treating evaporated fuel comprising:

a casing which is provided with a fuel vapor inlet, a purge port and an atmosphere communication port, said casing having a space area, one side of which communicates with said fuel vapor inlet and said purge port and another side of which communicates with said atmosphere communication port; and an adsorbent accommodated in the space area of said casing;

an air meandering passage disposed between said atmosphere communication port and said other side of the space area, said air meandering passage causing air sucked from the atmosphere communication port to zigzag to reach said other side of the space area; and a filter element disposed between said air meandering passage and said other side of the space area, said filter element filtering the air and introducing filtered air into said space area, said air meandering passage meanders on a plane, which is perpendicular to a longitudinal direction of the casing, and said air passage is composed of an end plate having an opening and a baffle member disposed on the end plate and having a shape preventing the air introduced through said atmosphere communication port from advancing straight toward the opening of the end plate, and said air passage is formed integrally with the casing.

13. A canister for treating evaporated fuel comprising:

a casing which is provided with a fuel vapor inlet, a purge port and an atmosphere communication port, said casing having a space area, one side of which communicates with said fuel vapor inlet and said purge port and another side of which communicates with said atmosphere communication port; and an adsorbent accommodated in the space area of said casing;

an air meandering passage disposed between said atmosphere communication port and said other side of the space area, said air meandering passage causing air sucked from the atmosphere communication port to zigzag to reach said other side of the space area; and a filter element disposed between said air meandering passage and said other side of the space area, said filter element filtering the air and introducing filtered air into said space area, said air meandering passage meanders on a plane, which includes a longitudinal direction of the casing, and said air passage is composed of an end plate having an opening and a baffle member including a first wall section and a second wall section, said first and second wall sections extending from different positions in opposite directions to each other so as to prevent the air introduced through said atmosphere communication port from advancing straight toward the opening of the end plate, and said air passage is formed integrally with the casing.

* * * * *